US005779513A

United States Patent [19]

Burton et al.

[11] Patent Number: 5,779,513

[45] Date of Patent: Jul. 14, 1998

[54] FLOTATION APPARATUS

[76] Inventors: Judith Ann Burton; Mary Bowes McKenzie, both of 20806 Juniper, Yorba Linda, Calif. 92686

[21] Appl. No.: 341,837

[22] Filed: Nov. 18, 1994

Related U.S. Application Data

[63] Continuation of Ser. No. 153,224, Nov. 15, 1993, abandoned.

[51] Int. Cl.[6] ..... B63C 9/08

[52] U.S. Cl. ..... 441/129

[58] Field of Search ..... 441/128, 129, 441/130, 131, 132, 136

[56] References Cited

U.S. PATENT DOCUMENTS

| | | | |
|---|---|---|---|
| 67,039 | 7/1867 | Golding | 441/128 |
| 689,020 | 12/1901 | Pruden | 441/129 |
| 1,329,687 | 2/1920 | Underwood | 441/129 |
| 4,634,393 | 1/1987 | Wood | 441/129 |
| 4,828,522 | 5/1989 | Santos | 441/129 |
| 5,049,102 | 9/1991 | Hull | 441/129 |
| 5,052,965 | 10/1991 | Klapp et al. | 441/130 |
| 5,090,695 | 2/1992 | Ciolino | 441/129 |
| 5,149,314 | 9/1992 | Ciolino et al. | 441/129 |
| 5,186,667 | 2/1993 | Wang | 441/129 |

FOREIGN PATENT DOCUMENTS

| | | | |
|---|---|---|---|
| 2075924 | 11/1981 | United Kingdom | 441/130 |

*Primary Examiner*—Jesus D. Sotelo
*Attorney, Agent, or Firm*—Donald E. Stout

[57] ABSTRACT

A flotation apparatus comprises first and second float sections, as well as a hinge section formed of a flexible material which extends between and joins the first and second float sections. The first and second float sections are comprised of a closed cell foam covered by a water resistant material, and are both of substantially the same constant thickness. The hinge section, preferably nonbuoyant, is constructed entirely of the same type of water resistant material which covers the foam in the first and second float sections. An important feature of the invention is that the hinge section is longer than at least one, and preferably both, of the float sections. Because the hinge section is so much thinner and more flexible than the float sections, the greater length of the hinge section permits the flotation apparatus to be folded very compactly for transportation and storage, and also permits the apparatus to be used in a variety of alternative modes in addition to prone flotation, the alternative modes including a chair or a sling, for example.

14 Claims, 2 Drawing Sheets

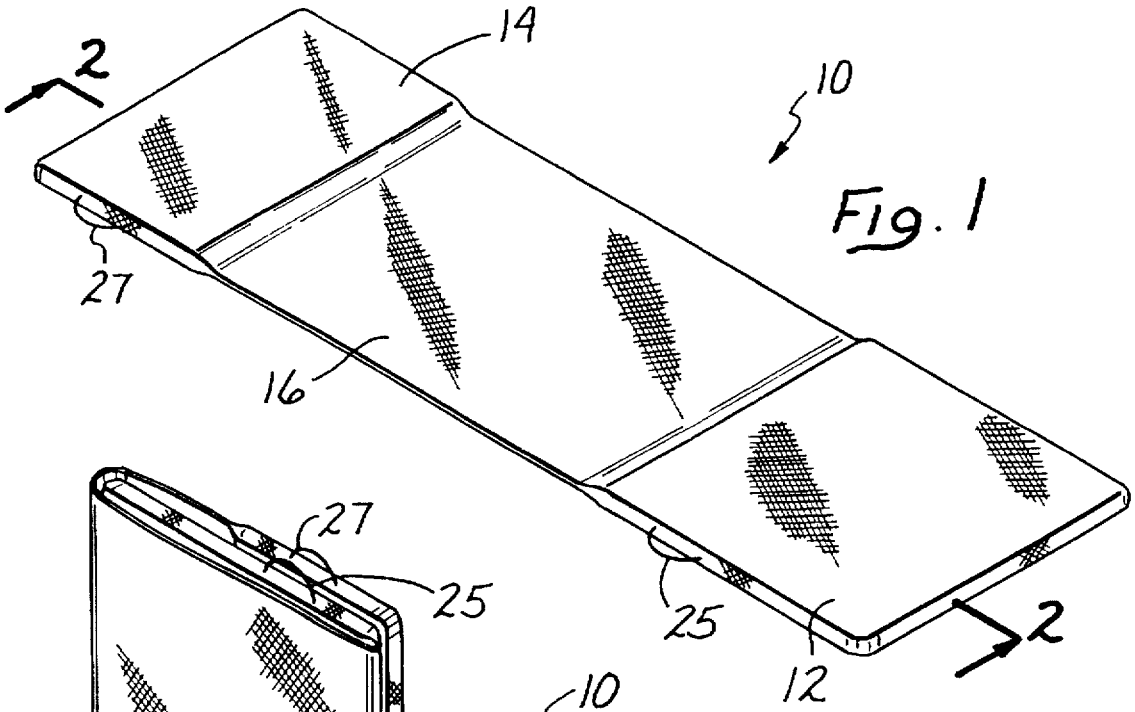
Fig. 1
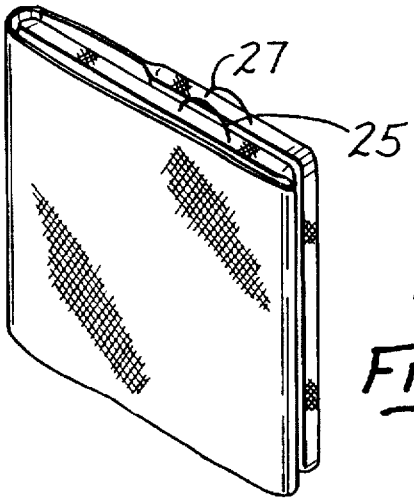
Fig. 3
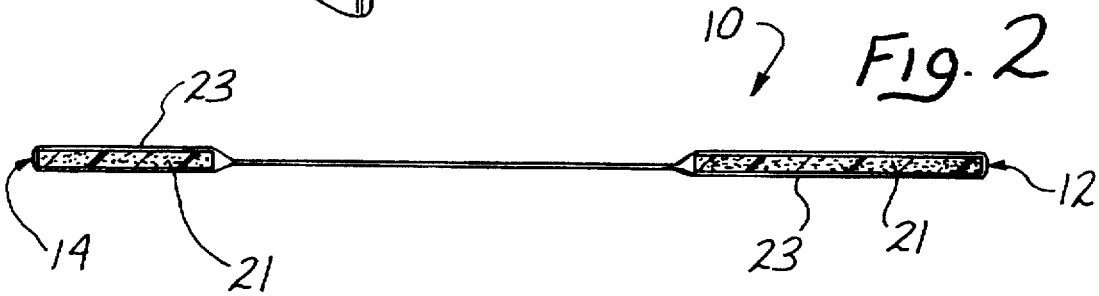
Fig. 2
Fig. 4
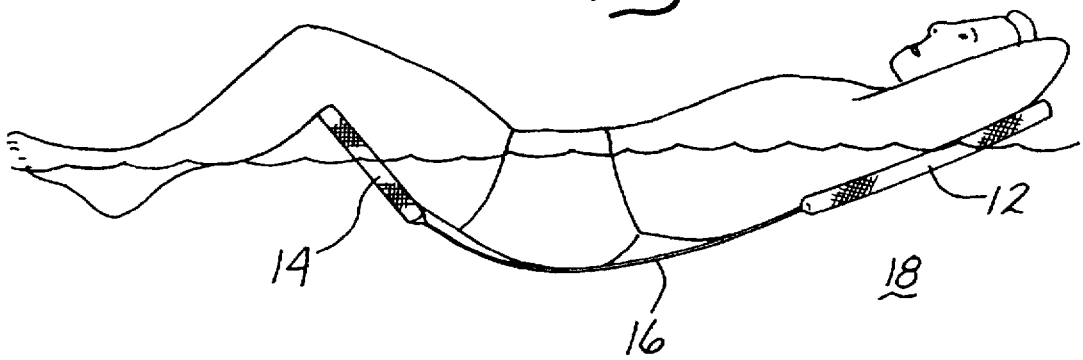

FLOTATION APPARATUS

This application is a continuation of application Ser. No. 08/153,224 filed Nov. 15, 1993 and also entitled "FLOTATION APPARATUS" now abandoned.

BACKGROUND OF THE INVENTION

This invention relates to an aquatic flotation device, and more particularly to an aquatic device requiring no inflation and being constructed for comfortable, relaxed flotation in a variety of modes, as well as very compact handling and storage.

Aquatic flotation devices now commonly used for recreational purposes are generally of the inflatable type. While satisfactory for flotation purposes, such devices are inconvenient because of the need to inflate them and because of their bulkiness when inflated. Thus, a person desiring to use such a device at a location remote from its place of storage often must inflate the device before transporting it to the remote location. This, of course, is inconvenient and often infeasible because of the bulkiness of the inflated flotation device. Alternatively, one may transport the device to the remote location in a deflated state and then inflate it on site. However, this approach is also often inconvenient because of the need for inflation equipment at the remote location and because of the time and effort necessary to complete the inflation process, as well as to deflate the device after the flotation activity. Yet another problem with inflatable flotation devices is their propensity for being punctured, ripped, or torn, which results in the need for repairs and may in some instances render the device useless.

Non-inflatable aquatic flotation devices are also known in the prior art. For example, U.S. Pat. No. 4,634,393 to Wood discloses an aquatic mat for recreational flotation which comprises an elongated slab and a headrest formed of a unicellular, non-water absorbent, plastic foam. This flotation device has the advantage of not requiring inflation, but also has disadvantages, particularly with respect to its ability to be compactly stored and handled. The mat is designed with a series of creases which render it more easily rolled up for storage and transportation. However, even in a rolled up configuration the mat will still be relatively bulky and difficult to handle and store. Additionally, it is often difficult to roll up such an item, particularly when it is wet.

Another disadvantage of the mat disclosed by Wood is its relative inflexibility when unrolled and ready for use, and its resultant mode of use limitations. For example, while the mat may be readily used for prone flotation, it is not particularly well suited for applications wherein the user relaxes in a flexed and largely immersed position, such as flotation in a seated position or use as a sling, because of its inflexibility as well as its relatively uniform buoyancy.

Another type of non-inflatable aquatic flotation device is disclosed in U.S. Pat. No. 5,090,695 to Ciolino. This patent discloses a float platform designed for use in aquatic exercise routines, and comprises a plurality of specifically dimensioned buoyant sections connected by flexing hinges. The hinges are relatively short with respect to the buoyant sections, being about 5–6 inches long, and serve the purpose of permitting easy flexing of the platform, so that a user may easily perform his or her routine. This Ciolino float platform is advantageous in that it may be collapsed to a certain extent, because of its hinged construction, for more compact storage and handling. However, because of its design, and the fact that it is buoyant along nearly its entire length, it is limited to relatively prone flotation with respect to the manner in which it may be used. It is not well suited for use in partially submersed and highly flexible applications such as a buoyant chair or sling.

SUMMARY OF THE INVENTION

This invention provides a flotation product for a person to use in water as a recliner, chair, or sling and having many desirable features. Its advantageous construction permits the user to be suspended in a relaxed, submerged position while maintaining his or her head and ears above the water. The flotation device is comfortable, easy to mount and dismount, lightweight, durable, and compact, so that it may be easily transported and stored. An important advantage of the inventive device is its flexibility; one may use the float in a variety of modes, such as prone flotation, as a chair, or as a sling.

More specifically, the inventive flotation apparatus comprises first and second float sections, as well as a hinge section formed of a flexible material which extends between and joins the first and second float sections. An important feature of the invention is that the hinge section is longer than at least one, and preferably both, of the float sections. This feature is particularly advantageous because the hinge section is less buoyant, and therefore thinner, than the float sections. Thus, since such a large portion of the length of the float apparatus is very thin and flexible, unlike the floats disclosed in the Wood or Ciolino patents, it may be folded about the hinge section to a very compact configuration, much more so than that of the Ciolino patent, thereby maximizing its portability and ease of storage. Also, the great flexibility and length of the thin hinge section, which is submersible and sized and adapted to extend from a region of the back of a user to a femoral region of the user, is the key feature which permits the float to be employed in a variety of modes, including chair and sling configurations.

Another important feature of the invention is that the first float section, which is sized and adapted to underlie the head and shoulders of a user, is longer than the second float section, which is sized and adapted to underlie a portion of the legs of the user. This relationship is important because the resultant greater buoyancy of the first float section ensures that the user's head and neck region will remain above the water even though much of the user's body will be immersed due to its support only by the long and less buoyant hinge section.

In its preferred embodiment, the first and second float sections of the float apparatus are comprised of a closed cell foam covered by a water resistant material, and are both of substantially the same constant thickness. The hinge section, preferably substantially non-buoyant, is constructed of the same type of water resistant material which covers the foam in the first and second float sections.

The hinge section may be of the same width as the float sections, or, alternatively, may be narrower than at least one of the float sections. Yet another modification is that the hinge section may comprise a plurality of spaced strips. None of these alternative embodiments affect the basic function of the device, but different configurations may be desirable based upon the primary intended use for the particular apparatus being supplied.

Yet another advantageous feature of the invention is the inclusion of at least one handle, which is positioned on at least one of the first and second float sections, by which the flotation apparatus may be carried and transported when in the folded configuration. Preferably, each of the float sections includes a handle thereon, with the handles being positioned such that when the flotation apparatus is in its folded configuration, the handles are in sufficient alignment to permit a user's fingers of one hand to be wrapped through both handles.

The invention, together with additional features and advantages thereof, may best be understood by reference to the following description taken in conjunction with the accompanying illustrative drawing.

BRIEF DESCRIPTION OF THE DRAWING

FIG. 1 is a perspective view of a preferred embodiment of the invention, showing the flotation apparatus in an unfolded state, ready for use;

FIG. 2 is a cross-sectional view taken along lines 2—2 of FIG. 1;

FIG. 3 is a perspective view of the apparatus illustrated in FIG. 1, showing the flotation apparatus in a folded state, ready to be transported or stored;

FIG. 4 is an elevational view illustrating a user employing the flotation apparatus of FIG. 1 for flotation in a body of water;

DESCRIPTION OF THE PREFERRED EMBODIMENT

Figure 5:
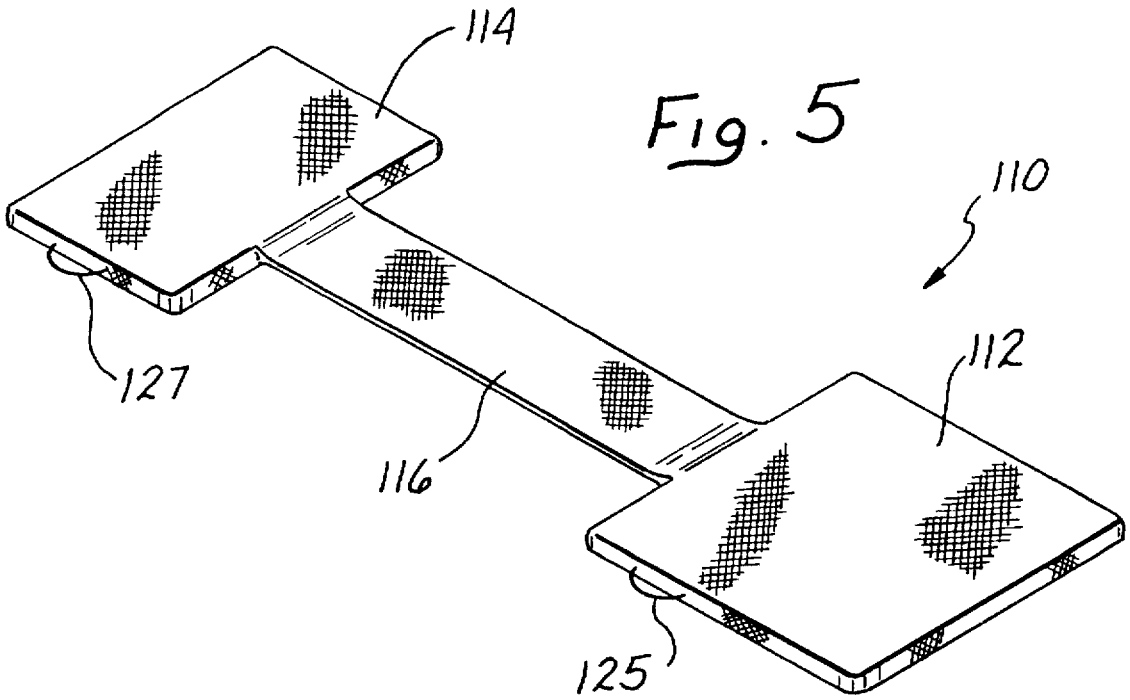
FIG. 5 is a perspective view similar to FIG. 1, illustrating a second modified embodiment of the inventive flotation apparatus.

In FIG. 1 there is shown a flotation apparatus, or float 10, in an unfolded configuration ready for use. In its preferred embodiment, the float 10 is comprised of three components, including a first float section 12, a second float section 14, and a hinge or connecting section 16 which connects the two float sections 12 and 14. As shown best in FIG. 4, when a user employs the float 10 for floating horizontally, lying on his or her back, in a body of water 18, the first float section 12 is preferably adapted to underlie and support the user's head, neck, and upper shoulder regions, while the second float section 14 is adapted to underlie and support the user's knee and lower femoral regions. It is preferred that the first float section 12 be longer than the second float section 14, because this helps to ensure that the user's head and ears remain out of the water when the sling is in use.

Referring now to FIG. 2, the two float sections 12 and 14 are preferably constructed of a highly buoyant closed cell foam 21 which is resilient, compressible, and non-water absorbent, such as foams produced from polyvinyl chloride (PVC), for example. One such foam material is produced by Uniroyal, Inc. under the tradename ENSOLITE, though other materials may also be employed, including other PVC-based foams or cross-linked polyethylene foams. Enclosing the foam 21 is a fabric covering 23, which preferably comprises a porous water resistant mesh formed of vinyl coated nylon. Other water-tolerant fabrics, such as cotton, polyester, or a combination of nylon, cotton, vinyl and/or polyester may also be utilized. The material forming the covering 23 is preferably heat sealable, so that the four edges of each float section may be heat sealed to retain the foam 21 in its desired position within the covering 23. Of course, the covering may be designed to provide access to the foam cushion 21 by means of a zipper or the like, if desired, and the four edges of the float section covering 23 may also be attached by some other conventional means, such as stitching, rather than by being heat sealed.

An important feature of the invention is that the hinge section 16 is less buoyant and thinner than either float section 12, 14, and is also longer than at least one, and preferably both, of the float sections. In the preferred embodiment, the hinge section is actually non-buoyant, and is comprised entirely of the same material that is utilized for the covering 23 in each of the float sections. It is, however, within the scope of the invention to employ a different material for the hinge section than the material which is used to cover the float sections. Furthermore, it would also be possible to utilize the same construction of foam encased within fabric as is utilized for each of the float sections, if desired, except that the foam for the hinge section would be considerably thinner and thus less buoyant than the foam used in the float sections.

One important advantage of the inventive float apparatus is its portability and its ability to be compactly stored. To increase its portability, a pair of handles 25 and 27 are provided, one on each of the float sections 12 and 14, respectively, as shown in FIGS. 1 and 3. The handles 25 and 27 are arranged so that they are substantially aligned when the float 10 is in its folded position (FIG. 3), thereby permitting a person's fingers of one hand to be wrapped through both handles simultaneously and thus providing a convenient means for carrying and transporting the float. Furthermore, in the preferred embodiment, the two float sections 12 and 14 have a common construction and thickness, which maximizes the comfort of the float 10 and permits it to be folded more compactly for storage or transportation. Additionally, as noted supra, the hinge section 16 is longer than either of the two float sections, and preferably is non-buoyant, thereby having a thickness equal only to the thickness of the fabric from which it is made, with no foam thickness to account for. This long, very thin hinge section further enhances the compactness of the float 10 when it is in its folded configuration.

With reference to specific dimensions for the various components of the float 10, the hinge section 16, which is designed to underlie the user between his or her mid-back region (bottom of the shoulder blades) and the femoral region (mid-femur), should be at least 12 and preferably between 18 and 36 inches in length. In the preferred embodiment, the length of the hinge section is approximately 26 inches. The first float section 12, which supports and underlies the user's head and upper shoulders, should be within the range of 12 to 24 inches in length, with a preferred length of approximately 16.5 inches. The second float section, which is designed to support the user's knee and lower femoral regions, should be within the range of 8 to 24 inches in length, with a preferred length of approximately 16 inches.

All three sections preferably have a common width of about 17 inches, though there is no requirement that any of the sections be of any particular width, nor is it required that they each be of the same width. It may be particularly desirable for the hinge section to be of a lesser width than either of the two float sections, as is illustrated, for example, in FIGS. 5 and 6.

FIG. 5 shows a modified embodiment of the float illustrated in FIG. 1, identical in all respects with that of FIG. 1 except with respect to the hinge section 116, which is modified in the manner described and shown herein. Each of the elements in FIG. 5 corresponding to equivalent elements in FIG. 1 are designated by the same reference numeral, preceded by the numeral 1. In the FIG. 5 embodiment, the hinge section 116 interconnects the two float sections 112 and 114, and is longer than either float section, as in the FIG.

1 embodiment, but is comprised of a single strip which is substantially narrower than the respective widths of both of the float sections. Such a configuration further reduces the bulk and weight of the float 110, while still retaining the other advantageous features of the invention, and may be more suitable for certain usage applications.

Figure 6:
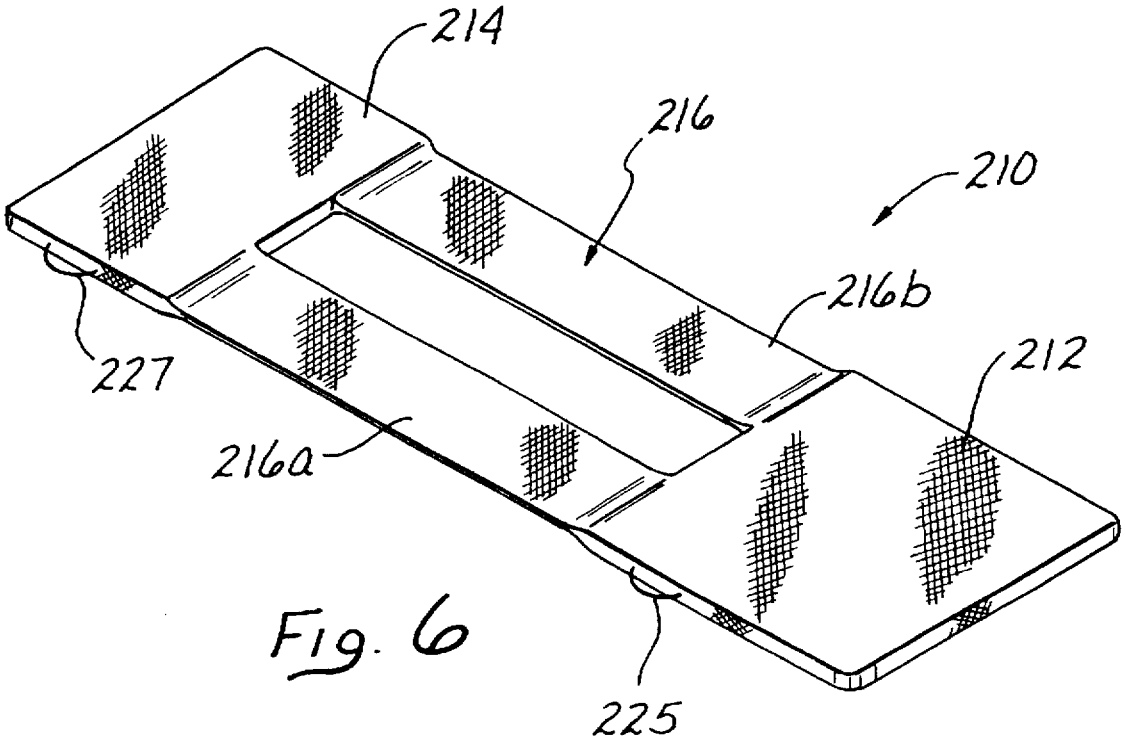
FIG. 6 is a perspective view similar to FIG. 1, illustrating a third modified embodiment of the inventive flotation apparatus.

Yet a second modified embodiment of the inventive float is illustrated in FIG. 6. Again, the FIG. 6 embodiment is identical in all respects with that of FIG. 1 except with respect to the hinge section 216, which is modified in the manner described and shown herein. Each of the elements in FIG. 6 corresponding to equivalent elements in FIG. 1 are designated by the same reference numeral, preceded by the numeral 2. In the FIG. 6 embodiment, the hinge section 216 interconnects the two float sections 212 and 214, and is longer than either float section, as in the FIGS. 1 and 5 embodiments, but is comprised of a pair of spaced strips 216*a* and 216*b* having a combined width substantially narrower than the respective widths of both of the float sections 212 and 214. This embodiment also reduces the bulk and weight of the float 210, while retaining the other advantageous features of the invention, and may be more suitable for some usage applications.

The invention as shown and described provides a comfortable, compact, and lightweight flotation device which permits a user to float horizontally in a relaxed, immersed position while his or her face and ears remain above the water surface. However, yet another advantage of the invention is its versatility because of the relatively long, non-buoyant and flexible hinge section. It may be used, for example, as a chair, wherein the user's posterior rests on the second float section 14 beneath the water's surface, and the remainder of the float 10 extends vertically upwardly such that the first float section 12 is above the surface of the water, with the user's head and neck resting against or adjacent to it. The float 10 may also be employed as a water sling, wherein the apparatus is oriented in a generally U-shaped configuration, and the user either sits on the hinge section 16 sideways, with the float sections 12 and 14 serving as arm rests, or straddles the hinge section with his or her legs.

The inventive device may be used in many other ways, and many other structural configurations are possible as well. For example, besides the alternative embodiments depicted in FIGS. 4 and 5, the float may be constructed to include three or more float sections, with a hinge section interconnecting each two float sections. It is also within the scope of this invention to construct each of the float sections differently, or of different foam and/or covering materials.

Accordingly, although an exemplary embodiment of the invention has been shown and described, many changes, modifications, and substitutions may be made by one having ordinary skill in the art without departing from the spirit and scope of the invention.

What is claimed is:

1. A flotation method comprising:

lying in the water on a flotation apparatus with the flotation apparatus oriented with respect to the user's body such that the head and shoulders of the user are on a first float section, a portion of the legs of the user which is above the knees of the user is on a second float section, the legs of the user beneath the knees are unsupported by the flotation apparatus and a flexible connecting section which is of less buoyancy than the first and second float sections and which joins the first and second float sections underlies the user from a mid back region of the user to a femoral region of the user whereby the flexible connecting section allows the user's body from the mid back region to the femoral region to be in the water.

2. A flotation apparatus, comprising:

a first float section sized and adapted to underlie the head and shoulders of a user;

a second float section sized and adapted to underlie a femoral portion of the legs of the user and being shorter than the first float section; and a connecting section formed of a flexible material and being less buoyant than the first and second float sections, said connecting section extending between and joining said first and second float sections, said connecting section being longer than either of said float sections, said connecting section being sized and adapted to extend from a mid back region of the user to a femoral region of the user and to terminate at such femoral region, and the flotation apparatus terminating at a distal end of the second float section.

3. A floatation apparatus as defined in claim 2 wherein the connecting section is at least 12 inches and not greater than 36 inches in length and is sized and adapted to extend to a mid-femoral region of the user.

4. A flotation apparatus as defined in claim 3 wherein the connecting section is at least 18 inches in length and each of said first and second float sections is between 8 and 24 inches in length.

5. A flotation apparatus as defined in claim 2, wherein said connecting section is at least 18 inches in length.

6. A flotation apparatus as defined in claim 2, wherein said connecting section is approximately 18 inches in length.

7. A flotation apparatus as defined in claim 2, wherein said connecting section is substantially non-buoyant.

8. A flotation apparatus as defined in claim 2, wherein said two float sections are both of substantially the same constant thickness.

9. A flotation apparatus as defined in claim 2, wherein said first and second float sections comprise a closed cell foam covered by a water resistant material.

10. A flotation apparatus as defined in claim 9, wherein said connecting section is comprised of the same type of water resistant material which covers the foam in said first and second float sections.

11. A flotation apparatus as defined in claim 2, wherein said connecting section is narrower than at least one of said float sections.

12. A flotation apparatus as defined in claim 2, wherein said connecting section comprises a plurality of spaced strips.

13. A flotation apparatus as defined in claim 2, wherein said flotation apparatus is foldable about said hinge section to assume a folded configuration, said flotation apparatus further comprising at least one handle which is positioned on at least one of said first and second float sections, by which said flotation apparatus may be carried and transported when in said folded configuration.

14. A flotation apparatus as defined in claim 13, wherein each of said float sections includes a handle on one side thereof, said handles being positioned so that when said flotation apparatus is in the folded configuration, the handles are in sufficient alignment to permit a person's fingers of one hand to be wrapped through both handles simultaneously.

* * * * *